United States Patent [19]

Schwarzel et al.

[11] 4,391,895

[45] Jul. 5, 1983

[54] DIFFUSION CONTROL LAYERS FOR DIFFUSION TRANSFER PHOTOGRAPHIC FILM

[75] Inventors: William C. Schwarzel, Billerica; Lloyd D. Taylor, Lexington, both of Mass.

[73] Assignee: Polaroid Corporation, Cambridge, Mass.

[21] Appl. No.: 222,031

[22] Filed: Jan. 2, 1981

[51] Int. Cl.[3] ..... G03C 1/76; G03C 1/40; G03C 1/48; G03C 5/54

[52] U.S. Cl. ..... 430/215; 430/227; 430/505; 430/536; 430/537

[58] Field of Search ..... 430/215, 227, 505, 536, 430/537

[56] References Cited

U.S. PATENT DOCUMENTS

| | | | |
|---|---|---|---|
| 3,785,815 | 1/1974 | Autges et al. | 96/3 |
| 3,834,902 | 9/1974 | Wright | 96/1.8 |
| 4,201,587 | 5/1980 | Bedell et al. | 430/224 |
| 4,288,523 | 9/1981 | Taylor | 430/215 |

*Primary Examiner*—John E. Kittle
*Assistant Examiner*—John L. Goodrow
*Attorney, Agent, or Firm*—Louis G. Xiarhos

[57] ABSTRACT

A diffusion control layer for a diffusion transfer photographic film unit comprising a urethane polymer including recurring backbone units capable of undergoing $\beta$-elimination degradation in an alkaline environment.

31 Claims, 1 Drawing Figure

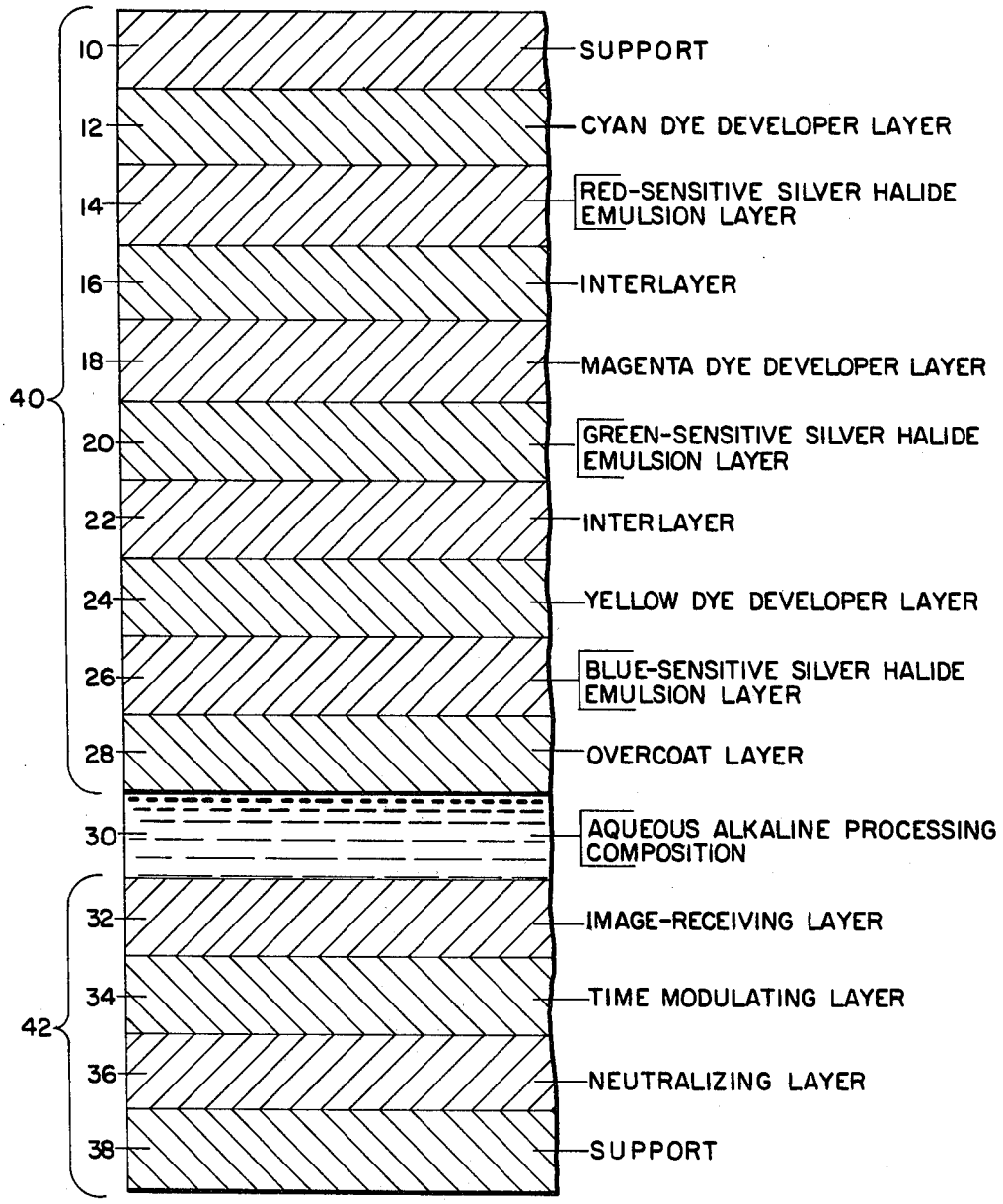
10
12
14
16
18
20
22
24
26
28
30
32
34
36
38
40
42
SUPPORT
CYAN DYE DEVELOPER LAYER
RED-SENSITIVE SILVER HALIDE EMULSION LAYER
INTERLAYER
MAGENTA DYE DEVELOPER LAYER
GREEN-SENSITIVE SILVER HALIDE EMULSION LAYER
INTERLAYER
YELLOW DYE DEVELOPER LAYER
BLUE-SENSITIVE SILVER HALIDE EMULSION LAYER
OVERCOAT LAYER
AQUEOUS ALKALINE PROCESSING COMPOSITION
IMAGE-RECEIVING LAYER
TIME MODULATING LAYER
NEUTRALIZING LAYER
SUPPORT

DIFFUSION CONTROL LAYERS FOR DIFFUSION TRANSFER PHOTOGRAPHIC FILM

Diffusion transfer photographic processes are well known in the art. Such processes have in common the feature that the final image is a function of the formation of an imagewise distribution of an image-providing material and the diffusion transfer of said distribution to an image-receiving layer. In general, a diffusion transfer image is obtained first by exposing to actinic radiation a photosensitive element, or negative film component, which comprises at least one light-sensitive silver halide layer, to form a developable image. Thereafter, this image is developed by applying an aqueous alkaline processing fluid to form an imagewise distribution of soluble and diffusible image-dye providing material, and transferring this imagewise distribution by diffusion to a superposed image-receiving layer, or positive film component, to impart a transfer image thereto.

The negative and positive components of a diffusion transfer photographic system may be separate elements which are brought together during processing and thereafter either retained together as the final print or separated following image formation; or, they may together comprise a unitary structure, an integral film unit wherein the negative and positive components are physically retained together prior to exposure and following image formation. Such integral film units are described, for example, in U.S. Pat. Nos. 3,415,644 and 3,594,165.

The image-dye providing materials which may be employed in diffusion transfer photographic processes generally may be characterized as initially soluble or diffusible in the processing composition but selectively rendered nondiffusible in an imagewise pattern as a function of development, or as initially insoluble or nondiffusible in the processing composition but selectively rendered diffusible in an imagewise pattern as a function of development. These materials include complete dyes or dye intermediates, e.g., color couplers.

A particularly useful class of image-dye providing materials for diffusion transfer processes are dye developers. These compounds contain, in the same molecule, both the chromophoric system of a dye and also a group adapted to develop exposed photographic silver halide. Although the principles presented are readily adaptable to other diffusion transfer processes, in order to simplify the presentation herein, the preferred diffusion transfer photographic process utilizing dye developer image-dye providing materials has been selected to be discussed in more specific detail below.

Multicolor images in a diffusion transfer system can be obtained by arranging a photosensitive element with at least two silver halide layers selectively sensitized to different regions of the spectrum. Such a system is shown, for example, in U.S. Pat. No. 2,983,606. To accomplish subtractive color photography, associated with each silver halide layer is a dye developer compound featuring an absorption that is substantially complementary in color to the color of the light recorded in the contiguous silver halide layer. The most commonly employed arrangement of this type includes three monochrome units—a blue-sensitive silver halide layer overlying a yellow dye developer, a green-sensitive silver halide layer overlaying a magenta dye developer and a red-sensitive silver halide layer overlying a cyan dye developer.

Such an exposed photosensitive element is processed using an aqueous alkaline processing composition containing an alkali, such a potassium hydroxide. The processing composition penetrates the layers of the negative element and dissolves the dye developer compounds by ionizing the developer groups. Once solubilized, the dye developers are capable of moving from their original positions to develop the latent image on the silver halide layers. In each silver halide layer, where the silver halide has been exposed, it is reduced and the oxidized dye developer becomes insoluble or at least substantially immobile. In unexposed regions of silver halide, the solubilized dye developer passes through the overlying layers and on through into an image-receiving layer to form a positive multicolor image.

Ideally, each dye developer should develop only its own contiguous, associated silver halide layer to which it is complementary. Specifically, the yellow dye developer should develop only the blue-sensitive silver halide; the magenta dye developer should develop only the green-sensitive silver halide; and the cyan dye developer should develop only the red-sensitive silver halide. In an actual system, however, while each dye developer will primarily develop its contiguous, complementary silver halide layer, the dye developers also have a tendency to stray and develop other nonassociated silver halide layers as well. If dye developer is free to migrate throughout the structure to another silver halide layer before the latter exposed silver halide layer has been fully developed by its respective associated dye developer, the resulting undesirable color contamination will produce transfer images having reduced color saturation and quality.

In order to remedy this interference, a wide variety of materials, offering varying degrees of effectiveness, has been suggested as diffusion control interlayers positioned between the silver halide layers to separate them from contiguous, nonassociated dye developer compounds. These interlayer materials are generally designed to prevent premature migration of a dye developer to a nonassociated silver halide layer before that silver halide layer has been fully developed by its own associated dye developer. Ideally, such interlayers should function to allow immediate unrestricted passage of processing composition alkali to initiate development of each of the silver halide layers by its respective dye developer. For a brief, predetermined initial period, however, the interlayer should be impermeable to the alkali-solubilized dye developer materials, so that each exposed silver halide layer will be developed by its respective complementary dye developer compound before a dye developer associated with another silver halide will be able to permeate the interlayer barrier and interfere with an unrelated development process. Following this initial, brief, predetermined period, after which all silver halide development processes should be completed, the interlayer should become substantially permeable to permit unrestricted passage of dye developers, which then are free to migrate through each of the silver halide layers en route to capture by a mordant in the image-receiving layer, where they will form a positive multicolor image.

The processing compositions employed in diffusion transfer processes are usually highly alkaline (e.g., $pH > 12$). However, after processing has been allowed to proceed for a predetermined period of time, it is desirable to neutralize the alkali of the processing composition in order to prevent further development and image dye transfer, and, in some instances subsequent oxidation which may have a material and substantial effect upon the stability to light of the resulting image in the image-receiving layer. Accordingly, a neutralizing layer, typically a nondiffusible acid-reacting reagent, is employed in the film unit to lower the pH from a first (high) pH of the processing composition to a predetermined second (lower) pH. For example, a polymeric acid neutralizing layer can be used, such as disclosed in U.S. Pat. No. 3,362,819, issued Jan. 9, 1968 and in U.S. Pat. No. 3,415,644 issued Dec. 10, 1968, both to E. H. Land. The polymeric acid comprises a polymer containing acid groups, preferably carboxyl groups, which are capable of forming salts with alkali metals, such as sodium or potassium, which are included in the processing composition.

In order to ensure that the pH reduction occurs after a sufficient, predetermined period and not prematurely so as to interfere with the development process, the neutralizing layer preferably is positioned behind a diffusion control time modulating layer. Ideally, this time modulating layer should initially be impermeable to alkali and then, after a brief predetermined period, should allow alkali to penetrate it readily to be depleted by the neutralizing layer and thereby shut-down the development process.

An additional factor to be considered in regard to diffusion control layers is that the rate of the development process involved in diffusion transfer photography is temperature-dependent. At reduced temperatures, the development process becomes markedly slower; at higher temperatures, the rate of development is increased. Such a range of development rates imposes additional performance demands on both interlayer and time modulating diffusion control layers. In specific, if a time modulating diffusion control layer were to permit penetration by alkali to the neutralizing layer while development were still incomplete because of a low temperature slow-down of the development process, development shut-down would be premature and image formation would be incomplete. Premature release of alkali-solubilized image dye-forming materials by an interlayer separating silver halide emulsion layers would produce undesirable color contamination. On the other hand, at increased development rates resulting from the effects of higher temperatures, late release by a diffusion control interlayer or time modulating layer could cause over-development, producing images of reduced dye density. Accordingly, to avoid the side effects of temperature variations, the ideal diffusion control layer should offer a temperature response substantially parallel to that of the development process.

Now, according to the present invention, a diffusion transfer photographic film unit is provided which includes a novel diffusion control layer separating individual adjacent components within said film unit to prevent premature interaction between the various components. The diffusion control layer may be used as an interlayer between two selectively photosensitive silver halide layers, said interlayer being initially impermeable to alkali-solubilized image-dye forming material but becoming permeable following a predetermined period after the interlayer has been contacted with an alkaline processing composition. In addition, according to the present invention, the novel diffusion control layer may be used as a time modulating layer shielding a neutralizing layer in such a manner that alkaline processing composition must first diffuse through the time modulating layer before coming in contact with said neutralizing layer, the time modulating layer initially presenting a barrier to alkali and then becoming readily permeable after a predetermined period. The diffusion control layers of the invention can also be utilized as an overcoat layer over the outermost silver halide layer.

Further, the novel diffusion control layer of the present invention features a temperature-dependent permeability mechanism compatible with the temperature dependence of silver halide development, so that detrimental premature or delayed release is avoided at varying ambient temperature conditions.

The novel diffusion control layer, according to the present invention, comprises a urethane polymer containing recurrent backbone units capable of undergoing $\beta$-elimination in an alkaline environment. This $\beta$-elimination mechanism effects a predetermined delay following exposure to an alkaline processing composition, after which the polymer backbone is severed, resulting in depolymerization and increased permeability.

The polymeric diffusion control layers of the present invention can be effectively utilized as a means for controlling the diffusion therethrough of an alkali or of certain materials soluble in or solubilized by an aqueous alkaline processing composition. Depending upon a desired photographic application and the nature of particular photographic materials or agents utilized, the diffusion characteristics of which are desirably controlled in predetermined manner, the permeability characteristics of a diffusion control layer of the invention can be adapted to suit such particular applications and utilizations.

For example, a diffusion control layer of the invention, based upon a urethane polymer comprising recurrent backbone units capable of undergoing a $\beta$-elimination reaction in an alkaline environment and of providing increased permeability of the layer, can be utilized as an interlayer in a photographic film unit. In accordance with a preferred mode of operation of an interlayer in a photosensitive element comprising at least two silver halide emulsion layers having associated image-providing material, the interlayer will be permeable to alkali, e.g., aqueous alkaline processing composition, but substantially impermeable to image-providing material until the $\beta$-elimination reaction and the resulting increase in permeability of the interlayer to such image-providing material. The utilization in a photosensitive element or film unit of an interlayer permeable to the alkali and certain other components of an aqueous alkaline processing composition, thus, permits the passage of alkali through the interlayer so as to effect initiation and substantial completion of development of silver halide emulsion layers while effectively preventing the permeation therethrough of image-providing material until the occurrence of a $\beta$-elimination reaction initiated by the alkaline environment and the resulting change in permeability of the interlayer to the passage of the image-providing material.

It will be appreciated that the molecular size of an image-providing material such as an image dye-providing material, a dye developer, dye intermediate or soluble silver complex is large relative to the considerably smaller molecular size or configuration of alkaline materials such as sodium or potassium hydroxide or the like customarily employed in an aqueous alkaline processing composition. Accordingly, an interlayer which is permeable to the passage of alkali therethrough so as to permit development in emulsion layers on either side of the interlayer, but which is substantially impermeable for a short and predetermined time to an image dye-providing material soluble in or solubilized by an alkaline processing composition, makes possible substantial development before an image dye-providing material associated with one emulsion layer can permeate through the interlayer to another emulsion layer. The utilization of an interlayer capable of permitting the passage of alkali for development of emulsion layers while providing a predetermined "hold" of image dye-providing material until the occurrence of a β-eliminating reaction and the "release" or opening of the interlayer to the passage of the image dye-providing material constitutes an effective utilization of a diffusion control layer of the invention in a photographic photosensitive element or film unit and a means by which interimage effects and associated dye loss and deficiencies in color fidelity may be mitigated or obviated.

Depending upon the nature of materials desirably controlled through the utilization of a diffusion control layer and the desired functional mode of the diffusion control layer, the nature and permeability characteristics of a diffusion control layer and β-elimination materials thereof can be varied to suit particular applications. Thus, the permeability characteristics of a diffusion control layer can be adapted to permit the passage of alkali and other components of an alkaline processing composition (so as to permit development of emulsion layers in a photographic film unit) while being substantially impermeable to image dye-providing material until the occurrence of a β-elimination reaction. Such predetermined permeability characteristics are especially desired in an interlayer or overcoat material as described herein and can be embodied in a diffusion control layer to suit such applications. Alternatively, a diffusion control layer of the invention can be adapted to prevent the passage, or effect a "hold," of alkali for a predetermined period until the occurrence of a β-elimination reaction. Such predetermined permeability characteristic is especially desired in a timing or spacer layer, as described herein for control of environmental pH conditions in a photographic film unit, and can be suitably embodied in a diffusion control layer adapted to function in accordance with this desired mode.

The permeability characteristics of a diffusion control layer of the invention can be controlled in a predetermined manner, for example, by varying the relative hydrophilicity of the layer, as by incorporating a comonomer or mixture of comonomers into a β-elimination polymer, by varying the thickness of the diffusion control layer, by appropriate utilization of β-elimination materials varying in the nature of their activating groups and reactivity, by the control of the mole ratio or proportion of β-elimination units in a polymeric β-elimination material, or by the utilization of additional materials, such as polymeric materials, in the diffusion control layer to control the permeation of the layer by alkali or aqueous alkaline processing composition or materials soluble in or solubilized by alkaline processing composition.

The urethane polymers that are used as diffusion control layers according to the present invention contain recurrent backbone units capable of undergoing β-elimination in an alkaline environment. The β-elimination reaction involves the elimination of two groups from adjacent carbon atoms to introduce a double bond into the molecule.

When elimination reactions involve β-substituted esters, acids, ketones, aldehydes and nitro compounds, they are commonly called β-eliminations. According to Hendrickson, Cram and Hammond, Organic Chemistry (3rd Edition, McGraw-Hill Book Company, 1970), the electron-withdrawing groups have strong acid-strengthening effects on the α-proton which is removed by base during the reaction.

Substituents which activate β-elimination under basic conditions are known. The nature of the activation in β-eliminations was studied by J. Crosby and C. J. M. Stirling in J. Chem. Soc. (B) 1970 page 671. It was concluded that resonance stabilization of a carbanionic species was an important component of activation. A further discussion of diffusion control polymers capable of undergoing β-elimination in an alkaline environment can be found in copending U.S. applications Ser. Nos. 130,527 and 130,532, filed Mar. 14, 1980.

Accordingly, the urethane polymer of the present invention comprises recurrent backbone units including a component having the formula:

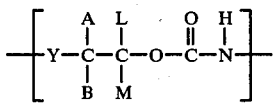

wherein

Y is a β-elimination activator selected from the group consisting of $-SO_2-$,

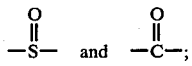

and

A, B, L and M are individually selected from the group consisting hydrogen, methyl and phenyl, with the proviso that at least one of the groups A and B is hydrogen.

Preferably, the activator group Y is a sulfonyl group, $-SO_2-$. It is also preferred that the majority of the groups A, B, L and M are hydrogen; most preferably, all of the groups A, B, L and M are hydrogen.

Urethane polymers, according to the present invention, can be prepared by reacting a diol having at least one functionality capable of undergoing β-elimination, with an organic diisocyanate. Typical such diols include:

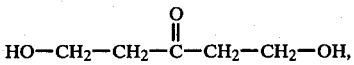

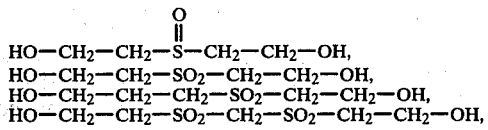

-continued $HO—CH_2—CH_2—SO_2—CH_2—O—CH_2—SO_2—CH_2—CH_2—OH,$
$HO—CH_2—CH_2—SO_2—CH_2—CH_2—O—CH_2—CH_2—SO_2—CH_2—CH_2—OH,$ and the like.

A preferred urethane polymer can be prepared by reacting bis-(2-hydroxyethyl)sulfone, $SO_2—(CH_2—CH_2—OH)_2$, with an organic diisocyanate. In order to enhance solubility of the resulting reaction product, for utility in a water based solvent system, it has been found to be preferable to incorporate a tertiary amine moiety into the polymer. This can be accomplished, for example, by including a tertiary amine-containing diol in the urethane reaction mixture to form a copolymer including recurrent units featuring a tertiary amine group. A particularly preferred urethane copolymer can be prepared by reacting bis-(2-hydroxyethyl)-sulfone and N,N'(2-hydroxyethyl)piperazine with an organic diisocyanate.

Any organic diisocyanate can be used to form the subject urethane polymer. Typical diisocyanates include toluene diisocyanate (TDI), ethylene diisocyanate, propylene diisocyanate, diphenylmethane 4,4'-diisocyanate, 2,2'-bitoluene-4,4-diisocyanate, xylylene diisocyanate, and the like. A preferred diisocyanate is toluene diisocyanate.

A particularly preferred water-soluble urethane polymer, according to the present invention, is the reaction product of bis-(2-hydroxyethyl)sulfone and N,N'-(2-hydroxyethyl)piperazine with toluene diisocyanate to form a copolymer having the formula:

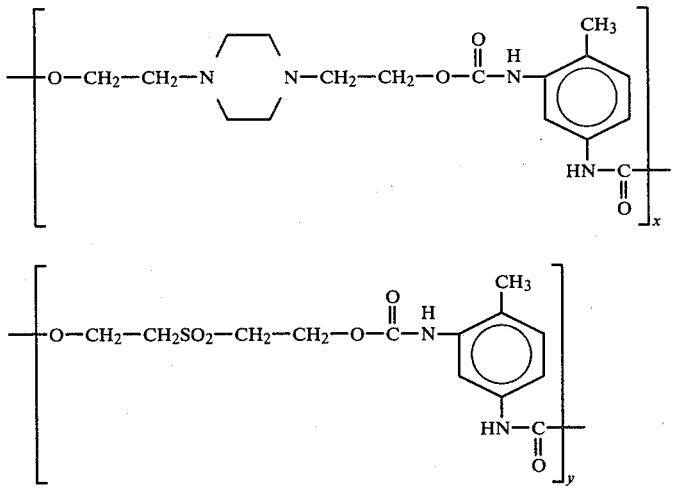

wherein the relative amounts of the polymer components "x" and "y" are determined by proportions of reactants. The values of "x" and "y" may be varied widely to obtain desirable properties; particularly favorable solubility and performance characteristics have been achieved with polymers having x:y ratios of about 8:2 to about 9:1.

Using this preferred copolymer as an illustration, an alkali induced $\beta$-elimination involving the sulfonyl-containing recurrent polymer unit results in depolymerization of the polymer at the urethane linkage. Since the symmetrical diol utilized in forming the copolymer is capable of $\beta$-elimination at both urethane linkages, it is likely that to some extent depolymerization occurs at both urethane linkages of the sulfonyl unit resulting in the formation of divinyl sulfone as a by-product. Generation of divinyl sulfone, a known gelatin hardening agent, may offer the consequential benefit that, subsequent to development, the gelatin-containing layers of the film unit will undergo cross-linking and hardening.

The $\beta$-elimination reaction can be represented by the equation below:

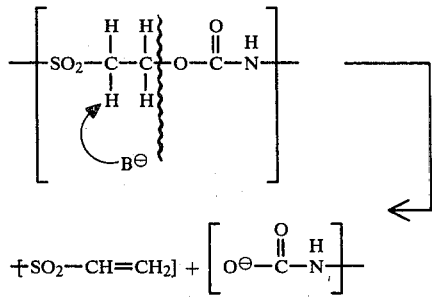

where B is a base.

Some depolymerization also likely occurs through hydrolysis of the carbamate linkage in the "x" component of the polymer chain. However, the $\beta$-elimination depolymerization of the "y" component is the critical cleavage mechanism which accomplishes the desired diffusion control properties of the polymers of the subject invention.

The invention may be further understood by reference to the FIGURE which is a magnified, diagrammatic, sectional view of a diffusion transfer photographic film unit.

Referring to the FIGURE, element 40 represents a photosensitive, or negative, film component which comprises a support layer 10, a cyan dye developer layer 12, a red-sensitive silver halide emulsion layer 14, a diffusion control interlayer 16, a magenta dye developer layer 18, a green-sensitive silver layer 20, a second interlayer 22, a yellow dye developer layer 24, a blue-sensitive silver halide emulsion layer 26 and a protective overcoat layer 28.

As illustrated in the FIGURE, the multilayer photosensitive element 40 has been selectively exposed to actinic radiation and is depicted in processing relationship with an image-receiving element 42 and a layer of processing composition 30 which has been distributed intermediate negative element 40 and positive element 42. Image-receiving element 42 may be a separate component or may be part of a permanently integral unit with the negative element.

Image-receiving or positive element 42 is shown comprising support 38, a polymeric acid neutralizing layer 36, a time modulating diffusion control layer 34 and an image-receiving layer 32.

As described in the discussion above, following exposure of negative element 40, aqueous alkaline processing composition 30 is applied to initiate development of the image. As the alkali penetrates the various layers of the negative, it reaches and solubilizes the dye developers in layers 24, 18 and 12. When they are solubilized, the dye developers are capable of moving from their original positions. However, interlayers 16 and 22 are selectively permeable and initially bar passage of the dye developers and restrict their migratory movement to within their associated, complementary silver halide layers. Accordingly, the yellow dye developer of layer 24 is limited to interaction only with the exposed blue-sensitive silver halide of layer 26, the magenta developer of layer 18 interacts only with the exposed green-sensitive silver halide of layer 20 and the cyan dye developer of layer 12 interacts only with the exposed red-sensitive silver halide of layer 14. In each silver halide emulsion layer, development of the exposed silver halide immobilizes its associated dye developer.

The silver halide emulsion layers 14, 20 and 26 of the photosensitive element preferably comprise optically sensitized silver halide, e.g., silver chloride, bromide or iodide, or mixed silver halides, such as silver iodobromide or chloroiodobromide dispersed in a suitable colloidal binder, such as gelatin. Such layers may typically be on the order of 0.6 to 6 microns in thickness. It will be appreciated that the silver layers may, and, in fact, generally do contain other adjuncts, e.g., chemical sensitizers such as are disclosed in U.S. Pat. Nos. 1,574,944; 1,623,499; 2,410,689; 2,597,915; 2,487,850; 2,518,698; 2,521,926; etc., as well as other additives performing specific desired functions, e.g., coating aids, hardeners, viscosity-increasing agents, stabilizers, preservatives, ultraviolet absorbers and/or speed-increasing compounds. While the preferred binder for the silver halide is gelatin, others such as albumin, casein, zein, resins such as cellulose derivatives, polyacrylamides, vinyl polymers, etc., may replace the gelatin in whole or in part.

Optical sensitization of the emulsion's silver halide crystals may be accomplished by contact of the emulsion composition with an effective concentration of optical sensitizing dyes selected to impart sensitivity to the silver halide in predetermined regions of the electromagnetic spectrum, e.g., red, green and blue; all according to the traditional procedures of the art, as described in, for example, Hamer, F. A., *The Cyanine Dyes and Related Compounds.*

The respective dye developers may be any of those in the aforementioned U.S. Pat. No. 2,983,606 and numerous other U.S. patents. As examples of U.S. patents detailing specific preferred "metallized" dye developers, mention may also be made of U.S. Pat. Nos. 3,563,739 and 3,551,406 (magenta dye); U.S. Pat. Nos. 3,597,200 and 3,705,184 (yellow dye); and U.S. Pat. No. 3,482,972 (cyan dye). The dye developers are preferably dispersed in an aqueous alkaline solution permeable polymeric binder, e.g., gelatin or a synthetic film-forming polymer such as disclosed in a multiplicity of prior patents, e.g., U.S. Pat. Nos. 2,992,104; 3,043,692; 3,069,203; 3,061,428; 3,044,873; and 3,069,264.

The interlayers serve to prevent interaction between a dye developer and a silver halide emulsion layer other than the silver halide by which its diffusion was intended to be controlled. The immobilization of a dye developer by exposed silver halide other than its intended associated silver halide would reduce the transfer density of the dye developer which should have been controlled. This would result in reduced color purity and/or saturation in the transferred dye image in the image-receiving layer. For example, if a diffusion transfer photographic film unit such as that shown in the FIGURE were exposed to red light only, in an ideal situation, upon imbibition of processing composition 30 and development of the red-sensitive silver halide emulsion of layer 14, all of the cyan dye developer of layer 12, situated behind the red-sensitive silver halide layer, should interact with the exposed red-sensitive silver halide so as to be prevented from migrating toward the image-receiving element. Thereby, a red image would be provided in the image-receiving element by the combined total migration of the magenta and yellow dye developers. If, however, the magenta dye developer of layer 18 were able to migrate to red-sensitive silver halide layer 14 to cause development of a portion of the exposed silver halide, the resultant image would no longer be pure red as it should be, but would be desaturated by a lack of a portion of magenta dye and, as well, could be contaminated by an amount of cyan dye that was freed for migration by the interaction of the magenta dye developer with a portion of the exposed red-sensitive silver halide.

The polymeric interlayer of the present invention may be employed as one or both of the interlayers 16 and 22 in a diffusion transfer negative element such as shown in the FIGURE. In such a structure, it is preferred that at least the rearmost interlayer comprise the interlayer of this invention. Because of its position in the negative relative to the processing composition, the rearmost interlayer 16 situated between the magenta dye developer layer 18 and the red-sensitive emulsion layer 14 is the most critical in regard to timed delay characteristics. Since the cyan dye developer layer 12 is the last to be activated by the processing composition, interlayer 16 must continue to maintain its barrier to yellow and magenta dye developers long enough to enable the cyan dye developer to fully develop all of the exposed silver halide of its associated red-sensitive emulsion. Preferably, both interlayers comprise a diffusion control polymer according to the present invention, and may comprise the same polymer or different polymers.

Other interlayer materials that may be used comprise alkaline permeable polymeric material such as gelatin and other materials such as those disclosed in U.S. Pat. Nos. 3,421,892; 3,575,701; 3,615,422 and 3,625,685. The interlayers may also contain additional reagents performing specific functions, e.g., various ingredients necessary for development may be contained initially in such layers in lieu of being present initially in the processing composition.

The overcoat layer 28 can be a protective layer of gelatin or any suitable alkali permeable material. If desired, it may contain various additives. In a preferred embodiment, overcoat layer 28 comprises diffusion control material according to the present invention, which serves as a barrier to premature dye developer migration to the image-receiving layer.

The liquid processing composition 30 introduced for effecting multicolor diffusion transfer processes comprises at least an aqueous solution of an alkaline material, for example, sodium hydroxide, potassium hydroxide, and the like, and preferably possessing a pH in excess of 12, and most preferably includes a viscosity-increasing compound constituting a film-forming material of the type which, when the composition is spread and dried, forms a relatively firm and relatively stable film. Typical viscosity-increasing compounds are mentioned, for example, in U.S. Pat. Nos. 2,543,181; 2,558,857; 2,616,807; 2,662,822; 2,983,606; 3,415,644; 3,594,164 and 3,594,165. The preferred film-forming materials include high molecular weight polymers such as polymeric, water-soluble ethers which are inert to an alkaline solution, such as, for example, hydroxyethyl cellulose or sodium carboxymethyl cellulose. Another preferred film-forming material is a polymeric oxime, such as are described in U.S. Pat. No. 4,202,694. Other film-forming materials or thickening agents whose ability to increase viscosity is substantially unaffected if left in solution for a long period of time are also capable of utilization. The film-forming material is preferably contained in the processing composition in such suitable quantities as to impart to the composition a viscosity in excess of 100 cps. at a temperature of approximately 24° C. and preferably in the order of 10,000 cps. to 100,000 cps. at that temperature.

A rupturable container of known description contains the requisite processing composition and is adapted upon application of pressure to release its contents for development of the exposed film unit, e.g., by distributing the processing composition in a substantially uniform layer between a pair of predetermined layers. As shown in the FIGURE, the processing composition is introduced as a layer 30 between overcoat layer 28 of the negative and image-receiving layer 32 of the positive element.

The yellow dye developer is not impeded at its migration towards the image-receiving layer and proceeds to migrate immediately upon solubilization. After the timed, abrupt breakdown of interlayers 16 and 22, the solubilized magenta and cyan dye developer compounds in the unexposed regions of silver halide also are free to pass through the overlying emulsions and on through the other layers to the image-receiving layer 32 where the dye developers are captured by a polymeric mordant and thereby impart thereto a positive dye transfer image.

As has been noted above, following image formation, the image-receiving element 42 may be separated from the photosensitive element 40 or it may remain permanently integral therewith, provided support 38 is transparent.

The supports 10 and 38 for the respective elements may be opaque or transparent, as desired, and may comprise any of the materials heretofore employed for such a purpose, e.g., paper base materials, ethylene glycol terephthalic acid, vinyl chloride polymers, polyvinyl acetate, polyamides, polymethacrylic acid methyl and ethyl esters, cellulose derivatives such as cellulose acetate, triacetate, nitrate, propionate, butyrate acetate or acetate butyrate, cross-linked polyvinyl alcohol, etc.

The image-receiving layer 32 generally comprises a dyeable material which is permeable to the alkaline processing composition. The dyeable material may comprise polyvinyl alcohol together with a polyvinyl pyridine polymer such as a poly-4-vinyl pyridine polymer. Such image-receiving layers are further described in U.S. Pat. No. 3,148,061 to Howard C. Haas. A preferred image-receiving layer material comprises a graft copolymer of 4-vinylpyridine, vinylbenzyltrimethylammonium chloride grafted on hydroxyethyl cellulose. Such graft copolymers and their use as image-receiving layers are further described in U.S. Pat. Nos. 3,756,814 and 4,080,346 issued to Stanley F. Bedell.

As disclosed in, for example, U.S. Pat. No. 3,362,819, the polymeric acid neutralizing layer 36 may comprise a nondiffusible acid-reacting reagent adapted to lower the pH from a first (high) pH of the processing composition to a predetermined second (lower) pH. The acid-reacting reagents are preferably polymers which contain acid groups, e.g., carboxylic acid and sulfonic acid groups which are capable of forming salts with alkali metals or with organic bases or potentially acid-yielding groups such as anhydrides or lactones. Preferably the acid polymer contains free carboxyl groups. As examples of useful neutralizing layers, in addition to those disclosed in the aforementioned U.S. Pat. No. 3,362,819, mention may be made of those disclosed in the following U.S. Patents: Bedell U.S. Pat. No. 3,765,885; Sahatjian et al. U.S. Pat. No. 3,819,371; Haas U.S. Pat. No. 3,833,367; Taylor U.S. Pat. No. 3,754,910 and Schlein U.S. Pat. No. 3,756,815.

A diffusion control time modulating layer 34 may be and is preferably disposed between the polymeric acid layer and the image-receiving layer in order to control the pH reduction so that it is not premature and hence will not interfere with the development process, e.g., to "time" control the pH reduction. Preferably, the diffusion control polymer layer of the present invention is employed as this time modulating layer. Suitable other spacer or "timer" layers for this purpose are described with particularity in U.S. Pat. No. 3,362,819 and in others, including U.S. Pat. Nos. 3,419,389; 3,421,893; 3,433,633; 3,455,686; 3,575,701; 3,785,815 and 3,856,522.

In an alternative embodiment, a polymeric acid neutralizing layer may be positioned in the negative element 40, adjacent support layer 10, separating the support from the innermost dye developer layer 12. A spacer or time modulating layer is disposed between the polymeric acid layer and the innermost dye developer layer to prevent premature pH reduction. The polymeric acid layer in the negative may serve either as a replacement or as a supplement for the polymeric acid layer in the image-receiving element. Such configurations are further described, for example, in U.S. Pat. Nos. 3,573,043, issued Mar. 30, 1970 and 3,362,821, issued Jan. 9, 1968, both to E. H. Land.

The following examples are provided to further illustrate the invention. The examples are intended to be illustrative and not limiting in nature.

Preparation of Diffusion Control Urethane Polymer

EXAMPLE I

To an ice cold, stirred solution of bis-(2-hydroxyethyl) sulfone (1.54 g, 0.01 mole) in dry DMF (400 ml), was added N,N'-(2-hydroxyethyl) piperazine (15.66 g, 0.09 mole), 2,4-toluene diisocyanate (17.4 g., 0.1 mole) obtained from Mobay Chemical Co. under the trademark MONDUR (TDS), stannous octoate catalyst (1 ml), and triethylenediamine catalyst (50 mg) obtained from Houdry Process and Chemical Co. under the trademark DABCO. The resulting mixture was stirred for 20 hours at ambient temperature. The reaction mixture then was dropped into methanol (1.2 l), the solvent was decanted and the product residue was washed with methanol and dried at reduced pressure. The resulting product (26.6 g) was a colorless amorphous gum identified by IR analysis as poly(diethylenesulfone 2,4-toluenedicarbamate)-co-(N,N'-diethylenepiperazine 2,4-toluenedicarbamate):

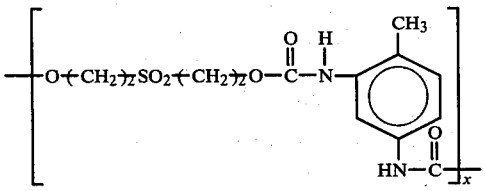

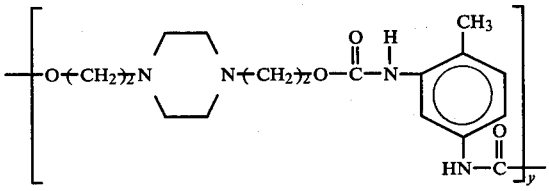

EXAMPLE II

Combined in an ice cold, stirred solution in 400 ml dry dimethyloformamide (DMF) were bis-(2-hydroxyethyl) sulfone (3.08 g, 0.02 mole), N,N'-(2-hydroxyethyl) piperazine (13.92 g, 0.08 mole), 2,4-toluene diisocyanate (17.4 g, 0.1 mole, "MODUR TDS" from Mobay Chemical Co.), stannous octoate (1 ml) and triethylenediamine (50 mg, DABCO from Houdry Process and Chemical Co.). The resulting mixture was stirred at ambient temperature for 20 hours. The reaction mixture then was dropped into methanol (1.2 l), the solvent was decanted, and the product residue was washed with methanol and dried at reduced pressure. 16.7 g of product was recovered. The product was identified by IR analysis as poly(diethylenesulfone 2,4-toluene-dicarbamate-co-N,N'diethylenepiperazine 2,4-toluenedicarbamate:

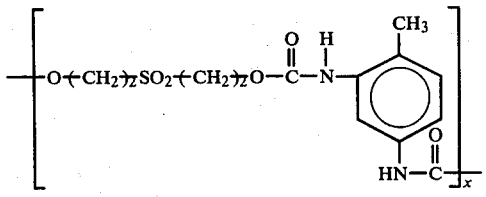

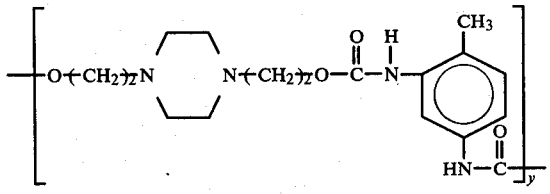

EXAMPLE III

To a stirred mixture of bis-(2-hydroxyethyl) sulfone (4.62 g, 0.03 mole) and N,N'-(2-hydroxyethyl) piperazine (12.2 g, 0.07 mole) in dry DMF (400 ml) at 20° C. was added hexamethylenediisocyanate (16 ml, 16.8 g, 0.1 mole), stannous octoate (20 drops), and triethylene diamine (50 mg) which formed a precipitate as it was stirred for 20 hours. Methanol (600 ml) then was added to the reaction mixture and the mixture was stirred at ambient temperature for one hour, after which the precipitate was collected. The precipitate was washed with methanol then resuspended in methanol (600 ml), collected, washed in methanol (200 ml) and then dried at reduced pressure. The resulting off-white solid product (22.2 g) was identified by IR analysis as poly(diethylenesulfone hexamethylene-dicarbamate)-co-(N,N'diethylenepiperazine hexamethylenedicarbamate):

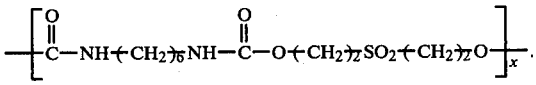

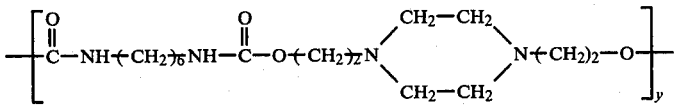

EXAMPLE IV

To a stirred mixture of bis-(2-hydroxyethyl)sulfone (1.54 g, 0.01 mole) and N,N'-(2-hydroxyethyl) piperazine (15.7 g, 0.09 mole) in dry DMF (400 ml) at 20° C. was added hexamethylene diisocyanate (16 ml, 16.8 g, 0.1 mole), stannous octoate (20 drops), and triethylene diamine (50 mg) causing the mixture to go into solution. The solution was continued to be stirred for 20 hours, during which period a precipitate formed. Methanol (600 ml) then was added and the reaction mixture was stirred for an additional hour at ambient temperature. The precipitate was collected, washed three times with methanol (200 ml), and dried at reduced pressure yielding 29.45 g of a white solid. The product was identified by IR analysis as poly(diethylenesulfone hexamethylenedicarbamate-co-(N,N'-diethylenepiperazine hexamethylenedicarbamate):

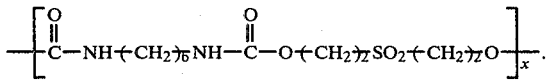

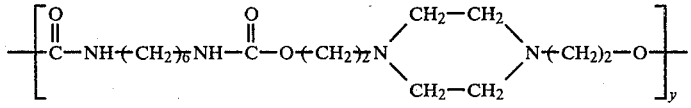

EXAMPLE V

To a stirred mixture of bis-(2-hydroxyethyl)sulfone (3.08 g, 0.02 mole) and N,N'-(2-hydroxyethyl) piperazine (13.9 g, 0.08 mole) in dry DMF (400 ml) at 20° F. was added hexamethylene-diisocyanate (16 ml, 16.8 g, 0.1 mole) stannous octoate (20 drops) and triethylenediamine (50 mg), causing solution and then precipitation as stirring was continued for 20 hours. Following this reaction time, methanol (500 ml) was added and the reaction mixture was stirred at ambient temperature for one hours. The precipitate then was collected, washed three times with methanol (200 ml), and dried at reduced pressure yielding 23.2 g of a white solid. The product was identified as poly(diethylene sulfone hexamethylenedicarbamate-co-(N,N'-diethylenepiperazine hexamethylenedicarbamate):

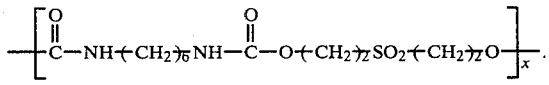

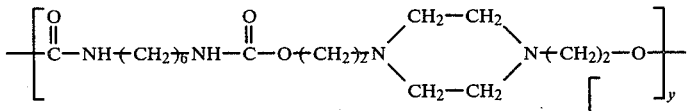

EXAMPLE VI (COMPARATIVE)

To a stirred mixture of N,N'-(2-hydroxyethyl) piperazine (17.4 g, 0.1 mole) in dry DMF (400 ml) at 20° C. was added hexamethylene diisocyanate (16 ml, 16.8 g, 0.1 mole), stannous octoate (20 drops) and triethylenediamine (50 mg), causing the mixture to go into solution. As the solution was stirred over a period of 20 hours, a precipitate formed. Methanol (600 ml) then was added and the reaction mixture was stirred for an additional 1 hour at ambient temperature. The precipitate was collected, washed 3 times with methanol (200 ml) and dried at reduced pressure to yield 30.3 g of an off-white solid. The product was identified by IR analysis as poly(N,N'-diethylenepiperazine hexamethylenedicarbamate):

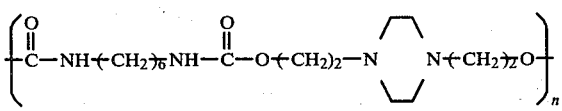

EXAMPLE VII (COMPARATIVE)

Combined in an ice cold, stirred mixture in dry DMF (400 ml) were N,N'-(2-hydroxyethyl)piperazine (17.4 g, 0.1 mole), 2,4-toluene diisocyanate (17.4 g, 0.1 mole), stannous octoate (1 ml), and triethylene-diamine (50 mg). The mixture was stirred for 20 hours at ambient temperature, and then was dropped into methanol (1.2 l). The solvent was decanted, and the residue was washed with methanol and dried at reduced pressure to yield 26.6 g of a colorless, amorphous gum. The product was identified by IR analysis as poly (N,N'-piperazine 2,4-toluenedicarbamate):

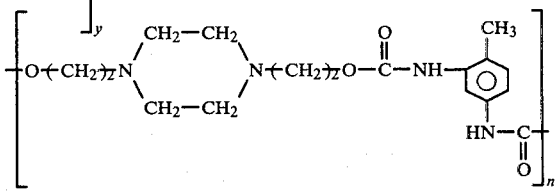

EXAMPLE VIII

In an ice cold blender, N,N'-(bis-(3-aminopropyl) piperazine (2.0 g, 0.1 mole) in water (50 ml) and bis-(2-hydroxyethyl) sulfone bis-chloroformate (2.79 g. 0.1 mole) in toluene (50 ml) was stirred slowly for 12 minutes. The reaction mixture then was vacuum filtered and the residue was washed with water. Freeze-drying the filtrate yielded 4.12 g of a light tan amorphous solid. This product was identified by IR analysis as poly(-diethylene sulfone N,N'-dipropylpiperazine dicarbamate bis hydrochloride:

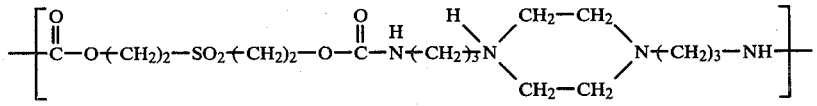

EXAMPLE IX

A solution of bis-(2-hydroxyethyl) sulfone bischloroformate (2.79 g, 0.01 mole) in 25 ml benzene was added to a solution of propane-1,3-diamine (0.74 g, 0.01 mole) and bis-(3-aminopropyl)methylamine (1.09 g, 0.0075 mole) in 25 ml ice water in a stainless steel blender. After the mixture was blended for five minutes, it was poured into a beaker and additional water was added. The benzene was decanted, and the product was collected by vacuum filtration, washed with $H_2O$ and dried at reduced pressure to yield 0.85 g of an off-white solid. The produce was identified by IR analysis as poly [diethylene sulfone-propane-1,3-diamine dicarbamate]-co-[bis-(3-aminopropyl)methylamine dicarbamate]:

$$\left[NH-(CH_2)_3-NH\right]\left[COO-(CH_2)_2-SO_2-(CH_2)_2-OOC\right]\left[NH-(CH_2)_3-\underset{\underset{CH_3}{|}}{N}-(CH_2)_3-NH\right]$$

EXAMPLE X

A solution of 2.64 g (9.46 mmoles) bis-(2-hydroxyethyl) sulfone bis-chloroformate in 25 ml benzene was layered onto a solution of 1.45 g (10 mmoles) bis-(3-aminopropyl)-methylamine in 30 ml $H_2O$ in which 20 ml Amberlite IRA-400 (ion exchange resin obtained commercially from Rohm & Haas) had precipitated in a 100 ml beaker. The polymer was removed at 5 minute intervals with tweezers and placed in a beaker of methanol containing a few drops of acetic acid (pH 6). After 5.5 hr., the mixture in methanol was evaporated at reduced pressure yielding 470 mg of a clear gum. The product was identified by IR analysis as poly-[diethylenesulfone bis-(3-amino propyl)-methylamine dicarbamate]:

$$\left[COO(CH_2)_2SO_2(CH_2)_2OOC-NH(CH_2)_3\underset{\underset{CH_3}{|}}{N}(CH_2)_3NH\right]_n$$

EXAMPLE XI

To an ice cold solution of 1.16 g (0.01 mole) 1,6-hexamethylenediamine and 1.68 g (0.02 mole) $NaHCO_3$ in 20 ml of $H_2O$ in a stainless steel blender was added a dolution of 2.79 g (0.01 mole) bis-(2-hydroxyethyl) sulfone bis-chloroformate in 6 ml benzene. After blending for 5 minutes, the mixture was washed into a beaker with 100 ml $H_2O$ and the off-white solid was collected by vacuum filtration, washed with water and dried under reduced pressure yielding 2.87 g. The product was identified by IR analysis as poly-(diethylenesulfone hexamethylenedicarbamate).

$$-COO-CH_2)_2SO_2-CH_2)_2OOC-NH-CH_2)_6NH)_n$$

EXAMPLE XII

To an ice cold solution of 87 mg (7.5 mmoles) 1,6-hexamethylenediamine and 1.09 g (7.5 mmoles) bis-(3-aminopropyl) methylamine in 20 ml $H_2O$ in a stainless steel blender was added a solution of 2.79 g (0.01 mole) bis-(2-hydroxyethyl)-sulfone bis chloroformate in 6 ml benzene. After blending for 5 minutes, the mixture was washed into a beaker with 100 ml $H_2O$, and the light tan solid was collected by vacuum filtration, washed with water and dried under reduced pressure yielding 1.5 g. The product was identified by IR analysis as poly-[diethylene sulfone hexamethylenedicarbamate]-co-[bis-(3-aminopropyl) methylamine dicarbamate]:

$$\left[NH(CH_2)_6NH\right]_a\left[COO(CH_2)_2SO_2(CH_2)_2OOC\right]_b$$

$$\left[NH(CH_2)_3\underset{\underset{CH_3}{|}}{N}(CH_2)_3NH\right]_c$$

EXAMPLE XIII

To an ice cold solution of 1.45 g (10 mmoles) bis-(3-aminopropyl) methylamine and 420 mg (5 mmoles) $NaHCO_3$ in 20 ml $H_2O$ in a stainless steel blender was added a solution of 2.79 g (10 mmoles) bis-(2hydroxyethyl) sulfone bis-chloroformate in 6 ml benzene. After blending for 5 minutes, the mixture was washed into a beaker with 100 ml $H_2O$ and the benzene was evaporated under a stream of $N_2$ for >24 hr. Dialysis with distilled $H_2O$, and drying under $N_2$ at reduced pressure yielded 1.1 g of a tan gum. This product was identified by IR analysis as poly-[diethylenesulfone bis-(3-aminopropyl)methylamine dicarbamate]:

$$\left[COO(CH_2)_2SO_2(CH_2)_2OOC-NH(CH_2)_3\underset{\underset{CH_3}{|}}{N}(CH_2)_3NH\right]_n$$

EXAMPLES XIV–XVII

In order to demonstrate the effectiveness of interlayers prepared in accordance with the present invention, monochrome test structures were assembled and evaluated. The test structures were sandwich arrangements of a trasparent support, a layer of cyan dye developer, the test interlayer material and a second transparent element, with provision for the introduction of an alkaline processing composition between the interlayer and second transparent element.

The monochrome test structures were made by first coating a transparent support with a layer comprising: 25 mg/ft$^2$ (269 mg/m$^2$) of a cyan dye developer, 40 mg/ft$^2$ (430 mg/m$^2$) gelatin and 1.5 mg/ft$^2$ (16.1 mg/m$^2$) of succinaldehyde, using conventional loop coater. The cyan dye developer can be represented by the following formula:

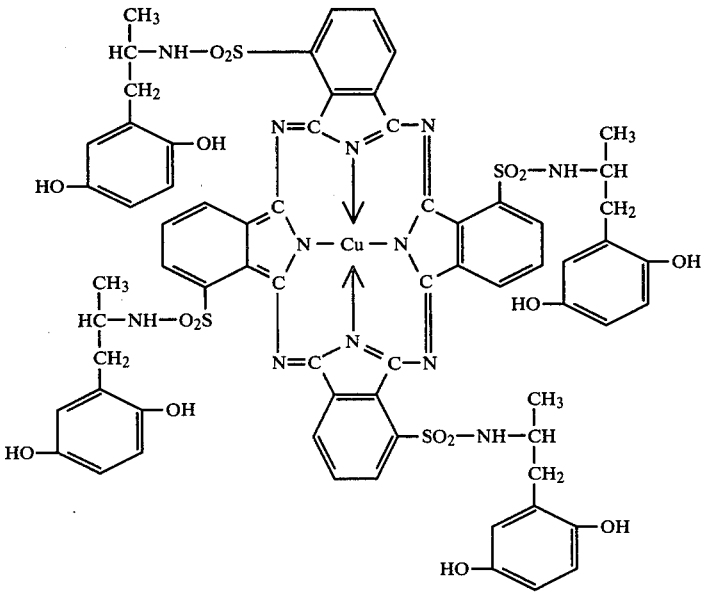

Over this layer was coated varying coverages of polymeric diffusion control interlayer compositions of the present invention. The polymers were dissolved in water containing a minimum amount of acetic acid; the solutions were filtered, if necessary, and then coated to form the interlayer. A conventional loop coater was employed for the coatings.

A clear transparent polyester film member then was superposed over the test elements to form a sandwich structure, and an alkaline processing composition was introduced between the interlayer and the polyester film member at a gap of 71 μm. The processing composition comprised the following components:

| | |
|---|---|
| Potassium hydroxide (45% aqueous solution) | 391 g |
| 6-methyl uracil | 32 g |
| Bis-2-methylbenzimidazole sulfide | 0.6 g |
| 6-benzylaminopurine | 10 g |
| 1-methylimidazole | 70 cc |
| Titanium dioxide | 1440 g |
| N—benzyl α-picolinium bromide (50% aqueous solution) | 98 g |
| Carboxymethyl hydroxethyl cellulose | 68 g |
| Water | 1700 g |

The evaluation of the subject interlayers was conducted using a backside dye diffusion analysis technique. This test analyzes the capacity of polymeric diffusion control layers of the invention to delay permeation therethrough of image-forming dye until conversion by a β-elimination reaction to a relatively dye-permeable polymer. In accordance with such analysis, dye transfer through the polymeric test material, e.g., and interlayer test material, is monitored in relation to time. The "hold-release" properties of a polymeric test material can be evaluated in simulation of the functioning of a material as, e.g., an interlayer in a photosensitive element. This analysis involved processing each test structure and monitoring the optical reflection density to red light of the processed sample, viewed through the backside of the test structure (i.e., viewed through the transparent support on the cyan dye side of the structure). The optical density as a function of time was continuously read using a MacBeth Quanta-Log densitometer equipped with a Hewlett Packard 17505A strip-chart recorder. In this manner, the dye developer is monitored as it is dissolved by the alkali of the processing composition and diffuses through the interlayer. The optical density read includes contributions from the dye materials in the dye developer layer and any dye material in the interlayer, but the titanium doxide in the processing composition masks the dye material that has diffused through the interlayer.

The parameters that were measured for each test structure included:

$\tau_1$—The time to effect dissolution of the dye developer material. This figure is a measure of the alkali permeability of the interlayer.

$\tau_2$—The time when alkali-dissolved dye developer material first began to diffuse through the interlayer and into the processing composition. This time measurement is commonly called the "delay time" or "hold time" and is a measure of the effectiveness of the interlayer as an initial timed barrier to the diffusion of dye developer.

Slope—The percentage of the total density change at a given time. This is a determination of the rate of dye developer material transfer through the interlayer and serves as a measure of the abruptness and completeness of the interlayer breakdown after the initial, timed barrier period.

$\epsilon_a$—The activation energy of the diffusion control layer to penetration by aqueous alkaline solutions. The value is determined by plotting the time (sec.) $\tau_1$, to effect dye developer dissolution on a logarithmic scale against the reciprocal of the temperature (°K.).

The activation energy (Kcal/mole) is determined from the slope of the straight line portion of the curve according to the equation:

$$\epsilon_a = R\left(\frac{\log Y_2/Y_1}{1/T_2 - 1/T_1}\right)$$

where $\epsilon_a$ is the activation energy; $T_2$ is the higher temperature and $T_1$ is the lower temperature; $Y_2$ is the dissolution time at $T_2$ and $Y_1$ is the dissolution time at $T_1$; and, R is a constant.

Table A, below, shows the delay time/slope results from monochrome testing structures with diffusion control layers comprising materials formulated according to EXAMPLES I, II, III, V and VII-Comparative, above. While desirable diffusion control characteristics may differ with varying dye diffusion photographic systems, the properties of the materials reported in the table generally indicate favorable hold-release capability. It is apparent from the table that the present invention provides a significant hold time before solubilized dye image-forming material is released, and accomplishes the dye release in a relatively short time span. The activation energy of the material prepared in Example II, in particular, shows favorable temperature dependence, closely matching that of silver halide development.

TABLE A

| Example | Diffusion Control Layer Polymer Example No. | Coverage (mg/m²) | 7.2° C. $t_1$ | 7.2° C. $t_2$ | 7.2° C. Slope | 24° C. $t_1$ | 24° C. $t_2$ | 24° C. Slope | 35° C. $t_1$ | 35° C. $t_2$ | 35° C. Slope | $\epsilon_a$ |
|---|---|---|---|---|---|---|---|---|---|---|---|---|
| XIV | I | 550 | .25 | .46 | 172 | .03 | .14 | 571 | .05 | .22 | 620 | 7 |
| | | | | | | .10 | .33 | 128 | | | | |
| | | 592 | .70 | 1.48 | 41 | .27 | .60 | 161 | .14 | .48 | 213 | 7 |
| | | | | | | .34 | .40 | 144 | | | | |
| XV | II | 819 | .49 | .85 | 214 | .10 | .17 | 582 | .03 | .12 | 310 | 22 |
| | | | | | | .10 | .20 | 520 | | | | |
| | | 1024 | .93 | 1.16 | 186 | .12 | .25 | 459 | .07 | .16 | 556 | 18 |
| | | | | | | .35 | | | | | | |
| XVI | IV | 1615 | | | | | .5 | 100 | | | | |
| XVII | V | 1615 | | | | | .16 | 200 | | | | |
| XVIII | VII-C | 346 | .07 | .12 | 103 | .04 | .06 | 252 | | .02 | 405 | |
| | | | | | | | .03 | 306 | | | | |
| XIX | VII-C | 171 | .04 | .07 | 173 | .02 | .15 | 201 | .01 | .09 | 264 | 6 |

EXAMPLES XX–XXIII

A measure of time of pH reduction can be had from a quantity which can be referred to as a "clearing time" which can be measured by use of the following system. An image-receiving element comprising in order on a support, a polymeric acid layer, a test timing layer and a mordanting layer, is spread with an alkaline processing material of high pH comprising an indicator dye which is highly colored at pH's of about 12 to 14 and colorless below about 10. A transparent cover sheet is superposed over the processing material. The view through the cover sheet toward the image-receiving element is dark until the alkali has penetrated to the polymeric acid layer where the pH is reduced by alkali consumption and the indicator dye becomes colorless, the system has "cleared." A skilled operator can determine when the clearing begins and when it is complete. A "leaky" timing layer allows a trickle of alkali through from the moment of first contact and shows no precipitous change in beginning to clear nor in the final clearing. A timing layer comprising the polymers of the instant invention will hold the alkali back for a definite timed period, and then, over a very short time interval, allow sufficient alkali through to drop the pH below the transition range of the indicator dye.

The effectiveness of the subject diffusion control materials as time modulating layers was demonstrated by measuring the quantity referred to as a "clearing time," using the method as outlined below.

An image-receiving element was prepared by successively coating a transparent 4 mil polyethylene terephthalate support film with the following layers:

1. A polymeric acid layer—the partial butyl ester of polyethylene/maleic anhydride copolymer mixed with about 10% by weight of polyvinyl butyral coated at a coverage of about 2500 mg/ft² (26919 mg/m²);
2. A time modulating layer—the subject polymeric materials. A control was prepared having no time modulating layer.
3. A polymeric image-receiving layer—a mixture of 6 parts by weight of polyvinyl alcohol, 3 parts by weight of poly-4-vinylpyridine and 1 part by weight of a graft polymer of 4-vinylpyridine-vinylbenzyltri-methyl ammonium chloride on hydroxyethylcellulose at a coverage of 300 mg/ft² (3229 mg/m²).

A clear transparent polyester film member then was superposed over the test element to form a sandwich structure, and an alkaline processing composition, including an indicator dye, was introduced between the image-receiving element and the polyester cover sheet at a gap of 0.0028 in. (0.0711 mm). The processing composition contained the following components:

| | |
|---|---|
| 100.00 g. | water |
| 4.02 g. | hydroxyethyl carboxymethyl cellulose |
| 4.15 g. | potassium hydroxide (50%) |
| 1.12 g. | benzotriazole |
| 0.50 g. | thymolphthalein |

The thymolphthalein indicator dye is highly colored at pH levels above about 12 and changes to become colorless at a pH below about 10. Accordingly, the dye initially is colored (processing composition pH>14) and becomes colorless as the alkali penetrates the time modulating layer to be neutralized by the polymeric acid. One can observe the test element through the transparent cover sheet and readily ascertain the time required by the alkali to penetrate the time modulating layers by noting the time for the processing composition to "clear" and become colorless as the pH approaches 10.

Table B, below, summarizes the test results for various time modulating layers, using materials prepared as set forth in preceding examples.

TABLE B

| Example | Time Modulating Layer: Polymer Example No. | Time Modulating Layer: Coverage ($mg/m^2$) | Clearing Time* (Sec.) |
|---|---|---|---|
| XX | VII-C | 297 | 500 |
| XXI | VII-C | 280 | 177 |
| XXII | I | 297 | 330 |
| XXIII | II | 243 | 66 |
| Control | | | 16 |

*@ 24° C.

What is claimed is:

1. A diffusion transfer photographic film unit comprising:

a photosensitive element including at least one photosensitized silver halide emulsion layer having an image-dye forming material associated therewith;

an image-receiving layer;

a means for introducing an alkaline processing composition within said film unit;

a neutralizing layer; and, at least one diffusion control layer positioned between interacting components of said film unit;

said diffusion control layer comprising a urethane polymer containing a recurrent backbone unit capable of undergoing $\beta$-elimination depolymerization in an alkaline environment.

2. The diffusion transfer photographic film unit of claim 1 wherein said diffusion control layer comprises recurrent polymer units including a component having the formula:

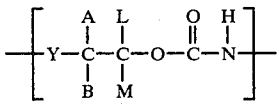

where

Y is a $\beta$-elimination activator selected from the group consisting of $—SO_2—$,

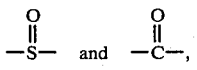

and

A, B, C and M are individually selected from the group consisting of hydrogen, methyl and phenyl, with the proviso that at least one of the groups A and B is hydrogen.

3. The diffusion transfer photographic film unit of claim 2 wherein said diffusion control layer comprises recurrent polymer units including a sulfonyl, $—SO_2—$, $\beta$-elimination activator.

4. The diffusion transfer photographic film unit of claim 3 wherein said diffusion control layer comprises a urethane polymer prepared by reacting a sulfonyl-containing diol with an organic diisocyanate.

5. The diffusion transfer film unit of claim 4 wherein said diffusion control layer comprises a urethane polymer containing a recurrent backbone unit capable of undergoing $\beta$-elimination so as as to generate a divinyl sulfone compound.

6. The diffusion transfer photographic film unit of claim 4 wherein said diffusion control layer comprises a urethane polymer prepared from bis-(2-hydroxyethyl)-sulfone.

7. The diffusion transfer photographic film unit of claim 4 wherein said diffusion control layer comprises a urethane polymer containing recurrent tertiary amine groups.

8. The diffusion transfer photographic film unit of claim 7 wherein said diffusion control layer comprises a urethane polymer prepared by reacting a sulfonyl-containing diol and a tertiary amine-containing diol with an organic diisocyanate.

9. The diffusion transfer photographic film unit of claim 8 wherein said diffusion control layer comprises a urethane polymer prepared by reacting bis-(2-hydroxyethyl) sulfone and N,N'-(2-hydroxyethyl) piperazine with an organic diisocyanate.

10. The diffusion transfer photographic film unit of claim 9 wherein said diffusion control layer comprises a urethane polymer prepared from a reaction mixture including toluene diisocyanate.

11. A photosensitive element for use in a diffusion transfer photographic process which comprises:

at least two selectively sensitized silver halide layers having image-dye forming materials associated therewith: and an interlayer separating said silver halide layers; said interlayer comprising a urethane polymer containing a recurrent backbone unit capable of undergoing $\beta$-elimination depolymerization in an alkaline environment.

12. The photosensitive element of claim 11 wherein said interlayer comprises recurrent polymer units including a component having the formula

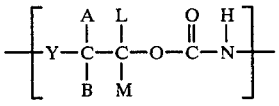

where

Y is a $\beta$-elimination activator selected from the group consisting of $—SO_2—$,

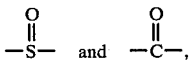

and

A, B, L and M are individually selected from the group consisting of hydrogen, methyl and phenyl, with the proviso that at least one of the groups A and B is hydrogen.

13. The photosensitive element of claim 12 wherein said interlayer comprises recurrent polymer units including a sulfonyl, $—SO_2—$, $\beta$-elimination activator.

14. The photosensitive element of claim 13 wherein said interlayer comprises a urethane polymer prepared by reacting a sulfonyl-containing diol with an organic diisocyanate.

15. The photosensitive element of claim 14 wherein said diffusion control layer comprises a urethane polymer prepared from bis-(2-hydroxyethyl)sulfone.

16. The photosensitive element of claim 14 wherein said interlayer comprises a urethane polymer containing recurrent tertiary amine groups.

17. The photosensitive element of claim 16 wherein said interlayer comprises a urethane polymer prepared by reacting a sulfonyl-containing diol and a tertiary amine-containing diol with an organic diisocyanate.

18. The photosensitive element of claim 17 wherein said interlayer comprises a urethane polymer prepared by reacting bis-(2-hydroxyethyl)sulfone and N,N'-(2-hydroxyethylpiperazine with an organic diisocyanate.

19. The photosensitive element of claim 18 wherein said interlayer comprises a urethane polymer prepared from a reaction mixture including toluene diisocyanate.

20. The photosensitive element of claim 11 for use in a diffusion transfer photographic process which comprises:

a support layer;

a red-sensitive silver halide layer having associated therewith a cyan image-dye forming material;

an interlayer;

a green-sensitive silver halide layer having associated therewith a yellow image-dye forming material;

an interlayer; and a blue-sensitive silver halide layer having associated therewith a magenta image-dye forming material;

at least one of said interlayers separating said silver halide layers comprising a urethane polymer prepared by reacting bis-(2-hydroeyethyl)sulfone and N,N'-(2-hydroxyethyl) piperazine with an organic diisocyanate.

21. The photosensitive element of claim 20 wherein said image-dye forming material is a dye developer.

22. The photosensitive element of claim 21 wherein said urethane polymer is prepared by reacting bis-(2-hydroxyethyl)sulfone and N,N'-(2-hydroxyethyl) piperazine with toluene diisocyanate.

23. A photographic element, for use in a diffusion transfer photographic process, including a neutralizing system for lowering the pH of an aqueous alkaline processing fluid, said neutralizing system containing a neutralizing layer and a time modulating layer so disposed with respect to the neutralizing layer that said alkaline processing fluid must first diffuse through the time modulating layer before contacting said neutralizing layer, said time modulating layer comprising a urethane polymer containing a recurrent backbone unit capable of undergoing $\beta$-elimination depolymerization in an alkaline environment.

24. The photographic element of claim 23 wherein said time modulating layer comprises recurrent polymer units including a component having the formula:

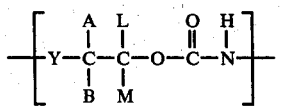

where

Y is a $\beta$-elimination activator selected from the group consisting of $-SO_2-$,

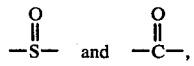

and

A, B, L and M are individually selected from the group consisting of hydrogen, methyl and phenyl, with the proviso that at least one of the groups A and B is hydrogen.

25. The photographic element of claim 24 wherein said time modulating layer comprises recurrent polymer units including a sulfonyl, $-SO_2-$, $\beta$-elimination activator.

26. The photographic element of claim 25 wherein said time modulating layer comprises a urethane polymer prepared by reacting a sulfonyl-containing diol with an organic diisocyanate.

27. The photographic element of claim 24 wherein said time modulating layer comprises a urethane polymer prepared from bis-(2-hydroxyethyl)sulfone.

28. The photographic element of claim 26 wherein said time modulating layer comprises a urethane polymer containing recurrent tertiary amine groups.

29. The photographic element of claim 28 wherein said time modulating layer comprises a urethane polymer diol and a tertiary amine-containing diol with an organic diisocyanate.

30. The photographic element of claim 29 wherein said time modulating layer comprises a urethane polymer prepared by reacting bis-(2-hydroxyethyl)sulfone and N,N'-(2-hydroxethyl) piperazine with an organic diisocyanate.

31. The photographic element of claim 30 wherein said time modulating layer comprises a urethane polymer prepared from a reaction mixture including toluene diisocyanate.

* * * * *